US009989874B2

(12) United States Patent
Murasawa et al.

(10) Patent No.: US 9,989,874 B2
(45) Date of Patent: Jun. 5, 2018

(54) CARRIER FOR DEVELOPING ELECTROSTATIC LATENT IMAGES, TWO-COMPONENT DEVELOPER, IMAGE FORMING APPARATUS, TONER STORING UNIT, AND SUPPLEMENTAL DEVELOPER

(71) Applicants: Yoshihiro Murasawa, Shizuoka (JP); Toyoaki Tano, Shizuoka (JP); Hiroyuki Kishida, Shizuoka (JP); Masato Taikoji, Shizuoka (JP); Kenichi Mashiko, Shizuoka (JP); Mariko Takii, Kanagawa (JP); Haruki Murata, Kanagawa (JP)

(72) Inventors: Yoshihiro Murasawa, Shizuoka (JP); Toyoaki Tano, Shizuoka (JP); Hiroyuki Kishida, Shizuoka (JP); Masato Taikoji, Shizuoka (JP); Kenichi Mashiko, Shizuoka (JP); Mariko Takii, Kanagawa (JP); Haruki Murata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/449,572

(22) Filed: Mar. 3, 2017

(65) Prior Publication Data

US 2017/0269497 A1 Sep. 21, 2017

(30) Foreign Application Priority Data

Mar. 17, 2016 (JP) ..... 2016-054123

(51) Int. Cl.

| | |
|---|---|
| ***G03G 9/113*** | (2006.01) |
| ***G03G 9/107*** | (2006.01) |
| ***G03G 9/08*** | (2006.01) |
| ***G03G 9/087*** | (2006.01) |
| ***G03G 9/09*** | (2006.01) |
| ***G03G 15/08*** | (2006.01) |

(52) U.S. Cl.

CPC ..... *G03G 9/1075* (2013.01); *G03G 9/0819* (2013.01); *G03G 9/08755* (2013.01); *G03G 9/091* (2013.01); *G03G 9/1131* (2013.01); *G03G 9/1133* (2013.01); *G03G 9/1136* (2013.01); *G03G 9/1139* (2013.01); *G03G 15/08* (2013.01); *G03G 2215/0607* (2013.01)

(58) Field of Classification Search

CPC ..... G03G 9/1139; G03G 9/11; G03G 9/113
See application file for complete search history.

(56) References Cited

U.S. PATENT DOCUMENTS

| | | | | |
|---|---|---|---|---|
| 4,590,141 | A | 5/1986 | Aoki et al. | |
| 2009/0214966 | A1 | 8/2009 | Kishida | |
| 2009/0297973 | A1 | 12/2009 | Iwamoto et al. | |
| 2010/0067958 | A1 | 3/2010 | Kishida et al. | |
| 2010/0068644 | A1 | 3/2010 | Nakajima et al. | |
| 2010/0136471 | A1 | 6/2010 | Yamada et al. | |
| 2010/0233613 | A1 | 9/2010 | Masuda et al. | |
| 2010/0239975 | A1 | 9/2010 | Yamaguchi et al. | |
| 2011/0042856 | A1 | 2/2011 | Aoto et al. | |
| 2011/0065037 | A1 | 3/2011 | Iwatsuki et al. | |
| 2011/0086307 | A1 | 4/2011 | Nakajima et al. | |
| 2011/0091802 | A1 | 4/2011 | Takahashi et al. | |
| 2011/0165508 | A1 | 7/2011 | Nakayama et al. | |
| 2011/0170915 | A1 | 7/2011 | Aoki et al. | |
| 2011/0171573 | A1* | 7/2011 | Sakata | G03G 9/10 430/111.1 |
| 2011/0177238 | A1 | 7/2011 | Aoto et al. | |
| 2011/0229817 | A1 | 9/2011 | Yamada et al. | |
| 2011/0293824 | A1 | 12/2011 | Aoto et al. | |
| 2012/0008979 | A1 | 1/2012 | Suzuki et al. | |
| 2012/0028183 | A1 | 2/2012 | Nakajima et al. | |
| 2012/0057898 | A1 | 3/2012 | Sakata et al. | |
| 2012/0058423 | A1 | 3/2012 | Yamaguchi et al. | |
| 2012/0064451 | A1 | 3/2012 | Kishida et al. | |
| 2012/0082488 | A1 | 4/2012 | Kubo et al. | |
| 2012/0201578 | A1 | 8/2012 | Mashiko et al. | |
| 2012/0230725 | A1 | 9/2012 | Sakata et al. | |
| 2012/0262739 | A1 | 10/2012 | Kubo et al. | |
| 2012/0264042 | A1 | 10/2012 | Taikoji et al. | |
| 2012/0315572 | A1 | 12/2012 | Mizutani et al. | |
| 2013/0004209 | A1 | 1/2013 | Kishida et al. | |
| 2013/0004212 | A1 | 1/2013 | Kubo et al. | |

(Continued)

FOREIGN PATENT DOCUMENTS

| | | |
|---|---|---|
| JP | 41-020153 | 11/1966 |
| JP | 42-001627 | 1/1967 |

(Continued)

OTHER PUBLICATIONS

U.S. Appl. No. 06/479,406, filed Mar. 28, 1983.

*Primary Examiner* — Hoa V Le
(74) *Attorney, Agent, or Firm* — Oblon, McClelland, Maier & Neustadt, L.L.P.

(57) ABSTRACT

A carrier for developing electrostatic latent images is provided. The carrier includes a magnetic core particle and a resin layer coating a surface of the magnetic core particle. The resin layer includes a particulate material A having a volume average particle diameter (a) and a particulate material B having a volume average particle diameter (b). The volume average particle diameter (a) of the particulate material A is the largest among volume average particle diameters of all particulate materials included in the resin layer, and an inequation 100≥(a)/(b)≥5 is satisfied. The particulate material A is barium sulfate.

14 Claims, 2 Drawing Sheets

(56) References Cited

U.S. PATENT DOCUMENTS

| | | | | |
|---|---|---|---|---|
| 2013/0016999 | A1 | 1/2013 | Tohmatsu et al. | |
| 2013/0065171 | A1 | 3/2013 | Yaguchi et al. | |
| 2013/0065175 | A1* | 3/2013 | Sakata | G03G 9/10 430/110.2 |
| 2013/0101930 | A1 | 4/2013 | Yamaguchi et al. | |
| 2013/0129395 | A1 | 5/2013 | Kubo et al. | |
| 2013/0244162 | A1 | 9/2013 | Yamada et al. | |
| 2013/0252160 | A1 | 9/2013 | Nagayama et al. | |
| 2013/0252169 | A1 | 9/2013 | Yaguchi et al. | |
| 2013/0260299 | A1 | 10/2013 | Nakajima et al. | |
| 2013/0260302 | A1 | 10/2013 | Nakajima et al. | |
| 2013/0260307 | A1 | 10/2013 | Nagayama et al. | |
| 2013/0334014 | A1 | 12/2013 | Mashiko et al. | |
| 2014/0072910 | A1 | 3/2014 | Iwatsuki et al. | |
| 2014/0079445 | A1 | 3/2014 | Katoh et al. | |
| 2014/0080052 | A1 | 3/2014 | Yaguchi et al. | |
| 2014/0227638 | A1 | 8/2014 | Kishida et al. | |
| 2014/0248557 | A1 | 9/2014 | Yaguchi et al. | |
| 2014/0255840 | A1 | 9/2014 | Sekiguchi et al. | |
| 2014/0348550 | A1 | 11/2014 | Nagayama et al. | |
| 2014/0348552 | A1 | 11/2014 | Iwatsuki et al. | |
| 2015/0153665 | A1 | 6/2015 | Kishida et al. | |
| 2016/0363880 | A1 | 12/2016 | Takii et al. | |
| 2017/0153563 | A1* | 6/2017 | Kishida | G03G 9/10 |
| 2017/0185000 | A1* | 6/2017 | Nagayama | G03G 15/0865 |
| 2017/0269497 | A1* | 9/2017 | Murasawa | G03G 9/0819 |

FOREIGN PATENT DOCUMENTS

| | | |
|---|---|---|
| JP | 43-027596 | 11/1968 |
| JP | 44-006397 | 3/1969 |
| JP | 45-026478 | 9/1970 |
| JP | 53-127726 | 11/1978 |
| JP | 55-127569 | 10/1980 |
| JP | 55-157751 | 12/1980 |
| JP | 56-140358 | 11/1981 |
| JP | 57-096355 | 6/1982 |
| JP | 57-096356 | 6/1982 |
| JP | 57-167033 | 10/1982 |
| JP | 58-207054 | 12/1983 |
| JP | 61-110161 | 5/1986 |
| JP | 62-273576 | 11/1987 |
| JP | 11-174740 | 7/1999 |
| JP | 2009-069471 | 4/2009 |
| JP | 2009-251483 | 10/2009 |
| JP | 2011-081360 | 4/2011 |
| JP | 2013-057817 | 3/2013 |
| JP | 2014-056108 | 3/2014 |
| JP | 2014-112191 | 6/2014 |

* cited by examiner

CARRIER FOR DEVELOPING ELECTROSTATIC LATENT IMAGES, TWO-COMPONENT DEVELOPER, IMAGE FORMING APPARATUS, TONER STORING UNIT, AND SUPPLEMENTAL DEVELOPER

CROSS-REFERENCE TO RELATED APPLICATIONS

This patent application is based on and claims priority pursuant to 35 U.S.C. § 119(a) to Japanese Patent Application No. 2016-054123, filed on Mar. 17, 2016, in the Japan Patent Office, the entire disclosure of which is hereby incorporated by reference herein.

BACKGROUND

Technical Field

The present disclosure relates to a carrier for developing electrostatic latent images, a two-component developer, an image forming apparatus, a toner storing unit, and a supplemental developer.

Description of the Related Art

In a typical electrophotographic image forming process, an electrostatic latent image is formed on an electrostatic latent image bearer and developed into a toner image with a developer. The toner image is transferred onto a recording medium, fixed thereon, and output as a printed matter. Electrophotographic technologies have been drastically improved recent years. For example, full-color copiers and printers have become mainstream in place of black-and-white copiers and printers, and functional white toner and transparent toner are now put on the market.

An electrophotographic two-component developer is generally composed of a toner and a carrier. The carrier is mixed with the toner in a developing chamber to charge the toner. The carrier carries the charged toner onto a photoconductor to form a toner image.

Generally, a carrier is composed of a core material and a resin layer that is coating the core material. Conventionally, the resin layer is formed of a low-surface-energy resin, such as fluororesin and silicone resin, for the purpose of extending the lifespan of the carrier. Such a resin layer forms of a uniform surface of the carrier, which prevents the occurrence of toner filming, an oxidization of the surface, a decrease in humidity resistance, and an adhesion of the carrier to a surface of a photoconductor, while extending the lifespan of the developer, protecting the surface of the photoconductor from scratch and abrasion, controlling charge polarity, and adjusting the amount of charge.

SUMMARY

In accordance with some embodiments of the present invention, a carrier for developing electrostatic latent images is provided. The carrier includes a magnetic core particle and a resin layer coating a surface of the magnetic core particle. The resin layer includes a particulate material A having a volume average particle diameter (a) and a particulate material B having a volume average particle diameter (b). The volume average particle diameter (a) of the particulate material A is the largest among volume average particle diameters of all particulate materials included in the resin layer, and an inequation $100 \geq (a)/(b) \geq 5$ is satisfied. The particulate material A is barium sulfate.

In accordance with some embodiments of the present invention, a two-component developer is provided. The two-component developer includes the above carrier and a toner.

In accordance with some embodiments of the present invention, an image forming apparatus is provided. The image forming apparatus includes an electrostatic latent image bearer, a charger, an irradiator, a developing device, a transfer device, and a fixing device. The charger charges the electrostatic latent image bearer. The irradiator forms an electrostatic latent image on the electrostatic latent image bearer. The developing device develops the electrostatic latent image formed on the electrostatic latent image bearer into a toner image with the above two-component developer. The transfer device transfers the toner image formed on the electrostatic latent image bearer onto a recording medium. The fixing device fixes the toner image on the recording medium.

In accordance with some embodiments of the present invention, a toner storing unit is provided. The toner storing unit includes a storing unit and the above two-component developer stored in the storing unit.

In accordance with some embodiments of the present invention, a supplemental developer is provided. The supplemental developer includes the above carrier and a toner.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
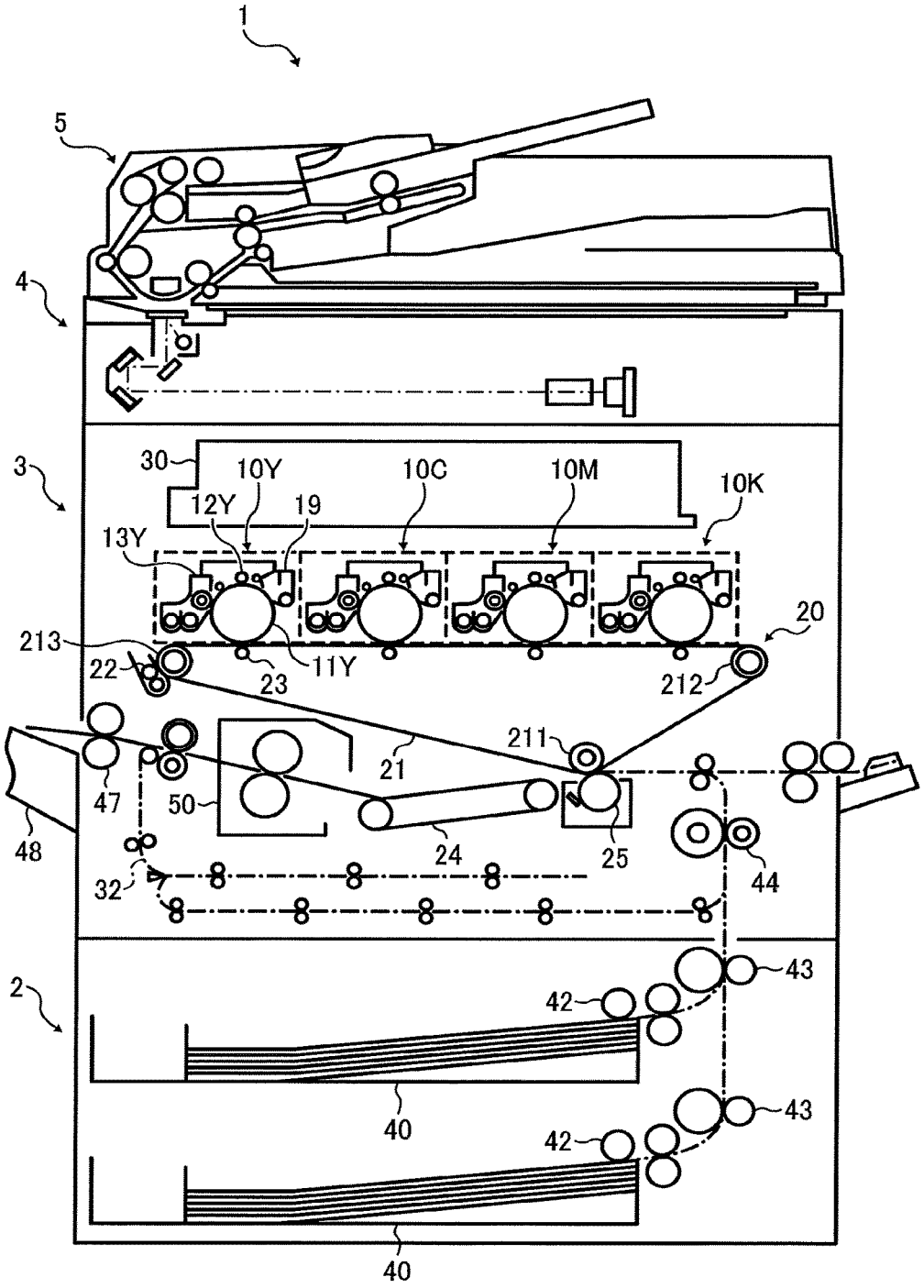
FIG. 1 is a schematic view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with recent demands for higher printing speed, longer lifespan, reduction of environmental burden of wastes, and reduction of printing cost per sheet, there is a need for a highly-durable carrier.

However, it may be difficult for high-speed printers, such as production printers that are commercially produced in large volume lately, to achieve high durability by improving the coating material of the carrier. There have been various attempts to blend fine particles in the coating material in an expectation of an improved film strength of the coating layer and secondary effects.

In view of this situation, one embodiment of the present invention provides a highly-durable carrier used for a two-component developer for developing electrophotographic latent images in electrophotography and electrostatic recording.

A carrier is suppressed from undergoing a temporal change in resistance by improving temporal durability of the carrier, by improving a coating material of the carrier. On the other hand, a carrier cannot be sufficiently suppressed from undergoing a temporal change in charge only by improving the coating material. This is because the charging ability of the coating material gets weakened as a toner base resin accumulates on the coating material with time. Thus, another technology for reliably controlling the charging ability of the carrier is demanded.

Under the current situation in that printers for mass printing, such as production printers, are put in the market in large volume, it is inevitable that the lifespan of carrier is much more extended. The lifespan of carrier can be extended when both a stable charging ability and a stable electric resistance are maintained over time.

One embodiment of the present invention provides a carrier for developing electrostatic latent images that includes a magnetic core material and a resin layer coating a surface of the magnetic core material. The resin layer includes a particulate material A having a volume average particle diameter (a) and a particulate material B having a volume average particle diameter (b). The volume average particle diameter (a) of the particulate material A is the largest among volume average particle diameters of all particulate materials included in the resin layer, and an inequation $100 \geq (a)/(b) \geq 5$ is satisfied. The particulate material A is barium sulfate.

Particles having a large particle diameter (hereinafter "large particles") project from the resin layer (hereinafter may be referred to as "resin coating layer"). Such large particles function as spacers that prevent the resin coating layer from contacting other carrier particles or toner particles, thus preventing abrasion of the resin coating layer. On the other hand, particles having a small particle diameter (hereinafter "small particles") impart film strength to the resin coating layer, thus preventing abrasion of the resin coating layer, either. Since the resin coating layer is thus suppressed from being abraded, the carrier is prevented from undergoing a temporal change in resistance, providing a longer lifespan and reliable image quality.

If an inequation $(a)/(b) > 100$ is satisfied, large particles will fall off the resin coating layer and a part of the core material will be exposed. If charge is injected into the exposed part of the core material, the carrier will adhere to a solid image part of an electrostatic latent image and will cause white voids, where toner partly absent like white dots, in the resulting toner image. In addition, the spacer effect that prevents abrasion of the resin coating layer cannot be expected. If an inequation $5 > (a)/(b)$ is satisfied, large particles will be not so large that the spacer effect cannot be expected. By contrast, small particles will be too large to improve the film strength of the resin coating layer. More preferably, an inequation $20 \geq (a)/(b) \geq 10$ is satisfied. In this case, the above-described effects for a longer lifespan and reliable image quality are well balanced.

The particulate material A having the largest volume average particle diameter is barium sulfate. Barium sulfate has high charging ability. Toner is easily chargeable by barium sulfate. Large particles of barium sulfate project from the resin coating layer, as described above. The projecting parts of the barium sulfate particles give charge to toner. Conventionally, as the number of printed sheets increases, a toner base resin adheres to the surface of the resin coating layer of the carrier in an accumulating manner, thereby inhibiting charging ability of the resin coating layer. As a result, the charge of the carrier is changed with time and therefore stable image quality cannot be secured over time. In the present embodiment, even when the toner base resin has accumulated on the resin coating layer to weaken charging ability of the resin coating layer, barium sulfate particles that are projecting form the resin coating layer secure charging ability of the carrier.

The carrier according to the present embodiment has achieved a longer lifespan and reliable image quality at the same time.

Preferably, the volume average particle diameter (a) of the particulate material A is in the range of from 400 to 1,000 nm. When the volume average particle diameter (a) is 400 nm or above, the particulate material A projects from the resin coating layer without being embedded therein, thus expressing charging ability to prevent the occurrence of toner scattering in a non-image part.

When the volume average particle diameter (a) is 1,000 nm or less, the particulate material A can be kept fixed in the resin coating layer without falling off even when being exposed to hazardous situations over time. If the particulate material A falls off the resin coating layer, a part of the core material will become exposed. If charge is injected into the exposed part of the core material, the carrier will adhere to a solid image part of an electrostatic latent image and will cause white voids, where toner partly absent like white dots, in the resulting toner image. In addition, if the particulate material A falls off the resin coating layer, temporal charge stability cannot be secured.

More preferably, the volume average particle diameter (a) of the particulate material A is in the range of from 480 to 800 nm. In this case, the particulate material A projects from the resin coating layer in such a manner that the lifespan and image quality of the carrier are much more improved.

Preferably, the particulate material B has conductivity. It is generally said that image quality is more improved when the resistance of a carrier is lowered as much as possible. When having conductivity, small particles (i.e., the particulate material B) can be more uniformly dispersed in the resin coating layer and thus the resistance of the carrier can be lowered efficiently. In addition, small particles (i.e., the particulate material B) can be more efficiently packed in the resin coating layer together with the charged particles (i.e. the particulate material A) when the volume average particle diameters of the particulate material A and the particulate material B are different from each other, thereby lowering the resistance of the carrier and improving image quality.

Preferably, the volume average particle diameter (b) of the particulate material B is in the range of from 4 to 100 nm. When the volume average particle diameter (b) is 4 nm or more, the particulate material B is not excessively small. The resistance of the carrier can be efficiently lowered and the occurrence of carrier deposition on edge and halo phenomenon can be prevented. When the volume average particle diameter (b) is 100 nm or less, the film strength of the resin coating layer is effectively improved, thereby suppressing abrasion of the resin coating layer. In addition, a temporal change in resistance becomes so small that carrier deposition is less likely to occur.

More preferably, the volume average particle diameter (b) of the particulate material B is in the range of from 25 to 50 nm. In this case, the improvement in film strength and the lowering of carrier resistance are well-balanced, and therefore a longer lifespan and image quality can be achieved at the same time.

There are various particulate materials which meet the above-described volume average particle diameter requirement. However, there is a limited selection of particulate materials having a required degree of conductivity. Examples of conductive particulate materials include carbon black as one representative. However, carbon black disadvantageously makes color toner, white toner, and transparent toner get blackened (i.e., causes color contamination) when used in combination with such toners. Examples of conductive particulate materials further include particulate silver as one example of whitish conductive particulate materials. However, particulate silver can be blended in the resin coating layer only in a small amount due to its excessively high conductivity, resulting in a poor film strength.

Preferably, the particulate material B is a tin oxide compound. Examples of the tin oxide compound include indium-doped tin oxide (ITO), phosphor-doped tin oxide (PTO), and tungsten-doped tin oxide (WTO), all of which have a whitish color and an appropriate conductivity. These compounds can be blended in the resin coating layer in an amount needed for improving film strength of the resin coating layer.

In particular, tungsten-doped tin oxide (WTO) has the most appropriate conductivity for achieving a good balance between film strength and conductivity.

Particle diameters of particulate materials existing in the resin layer can be determined by any known method. In one example method, a carrier is cut with an FIB (Focused Ion Beam) and the cross-section is observed with a SEM (Scanning Electron Microscope).

More specifically, a sample (carrier) is adhered onto a piece of carbon tape and gets an osmium coating having thickness of about 20 nm that protects the surface of the sample and gives conductivity thereto. The sample is thereafter subjected to an FIB treatment using an instrument NVision 40 (product of Carl Zeiss (SII)) under the following conditions.

Accelerating Voltage: 2.0 kV
Aperture: 30 μm
High Current: ON
Detector: SE2
In Lens
Conductive Treatment: None
W.D.: 5.0 mm
Sample Tilt Angle: 54°

The sample is then subjected to a SEM observation and an element mapping using an electron cooling SDD detector ULTRA DRY (having a diameter of 30 $mm^2$) and an analysis software program NORAN System 6 (NSS), both products of Thermo Fischer Scientific Inc., under the following conditions.

Accelerating Voltage: 3.0 kV
Aperture: 120 μm
High Current: ON
Conductive Treatment: Os
Drift Correction: Yes
W.D.: 10.0 mm
Measurement Method: Area Scan
Accumulation Time: 10 sec
Accumulation Number: 100 times
Sample Tilt Angle: 54°

From the SEM images of the cross-section of the carrier, 100 particles of each particulate material are randomly selected and subjected to an image processing to determine the circle-equivalent diameter of each particle, using an image processing software A-zou Kun (product of Asahi Kasei Engineering Corporation). The volume average particle diameter of each particulate material is calculated from the average circle-equivalent diameter among the 100 randomly-selected particles.

Preferably, the volume ratio of the all particulate materials (i.e., the particulate material A, the particulate material B, and other particulate materials) in the resin layer to the solid contents in the resin layer ranges from 0.1 to 20.

The resin layer of the carrier may include a silicone resin and/or an acrylic resin. Acrylic resins have high adhesiveness and low brittleness, thereby exhibiting superior abrasion resistance. At the same time, acrylic resins have a high surface energy, which causes a spent toner to easily adhere thereto. When applied to a carrier, an acrylic resin may cause charge decrease in the carrier as a spent toner is accumulated on the carrier. This problem can be solved by using a silicone resin in combination with the acrylic resin. In contrast to acrylic resins, silicone resins have a low surface energy, which suppresses a spent toner from adhering thereto. In addition, when included in the resin layer, silicone resins allow the resin layer to be abraded, thus preventing a spent toner from accumulating on the carrier. At the same time, silicone resins have a drawback of poor abrasion resistance because of their low adhesiveness and high brittleness. When combining an acrylic resin and a silicone resin each having opposing properties, it is possible to obtain a resin layer that exhibits superior resistance to spent toner and abrasion.

In the present disclosure, silicone resins refer to all known silicone resins, such as straight silicone resins consisting of organosiloxane bonds, and modified silicone resins (e.g., alkyd-modified, polyester-modified, epoxy-modified, acrylic-modified, and urethane-modified silicone resins). Specific examples of commercially available silicone resins include, but are not limited to, KR271, KR255, and KR152 (from Shin-Etsu Chemical Co., Ltd.); and SR2400, SR2406, and SR2410 (from Dow Corning Toray Co., Ltd.). The silicone resin can be used alone or in combination with other components such as a cross-linking component and a charge controlling component. Specific examples of commercially available modified silicone resins include, but are not limited to, KR206 (alkyd-modified), KR5208 (acrylic-modified), ES1001N (epoxy-modified), and KR305 (urethane-modified) (from Shin-Etsu Chemical Co., Ltd.); and SR2115 (epoxy-modified) and SR2110 (alkyd-modified) (from Dow Corning Toray Co., Ltd.).

Preferably, the resin layer includes a resin containing a cross-linked product obtained by subjecting a copolymer including structural units represented by the following formulae (A) and (B) to a hydrolysis to generate silanol groups, and thereafter a condensation.

Formula (A)

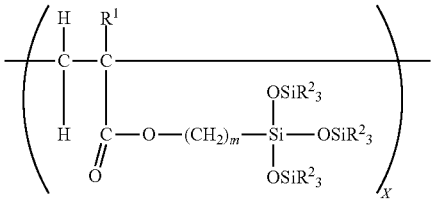

In the formula (A), $R^1$ represents a hydrogen atom or methyl group, $R^2$ represents an alkyl group having 1 to 4 carbon atoms, m represents an integer of from 1 to 8, and X represents a molar percent of from 10 to 90.

Formula (B)

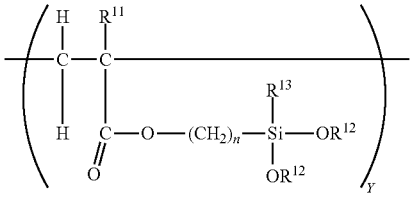

In the formula (B), $R^{11}$ represents a hydrogen atom or methyl group, $R^{12}$ represents an alkyl group having 1 to 4 carbon atoms, $R^{13}$ represents an alkyl group having 1 to 8 carbon atoms or an alkoxy group having 1 to 4 carbon atoms, n represents an integer of from 1 to 8, and Y represents a molar percent of from 10 to 90.

X and Y represent constitutional ratios of the formulae (A) and (B), respectively, in the copolymer.

When the above resin is used in combination with a silicone resin, charging ability of the carrier can be more properly adjusted. One key point of the present invention is to secure temporal stability of charging ability. In order to enhance charging ability of the resin layer of the carrier, preferably, the above resin is used in combination with a silicone resin.

The above resin suppresses the occurrence of resistance increase in the carrier, and the carrier thereby secures temporal resistance stability. In addition, the above resin effectively suppresses adhesion of a spent toner to the carrier. Each of the above-described resins may be used alone or combination with others. Form the aspect of curability, it is preferable that multiple types of resins are used in combination.

In the condensation of silanol groups, titanium-based, tin-based, zirconium-based, and/or aluminum-based catalysts can be used. Among such catalysts, titanium-based catalysts have superior catalytic properties. Specifically, titanium diisopropoxybis(ethyl acetoacetate) is most preferable. Such catalysts are considered to effectively accelerate condensation of silanol groups while maintaining good catalytic ability.

In the present disclosure, acrylic resins refer to all known resins containing an acrylic component. The resin in the resin layer may include either an acrylic resin alone or a combination of an acrylic resin with at least one cross-linkable component. Specific examples of the cross-linkable component include, but are not limited to, an amino resin and an acidic catalyst. Examples of the amino resin include, but are not limited to, guanamine resins and melamine resins. Examples of the acidic catalyst include, but are not limited to, catalysts having a reactive group of a completely alkylated type, a methylol group type, an imino group type, or a methylol/imino group type.

Another preferred example of the resin in the resin layer includes a cross-lined product of an acrylic resin with an amino resin. When including such a cross-linked product, the resin layers are prevented from fusing with each other, while remaining proper elasticity.

Examples of the amino resin include, but are not limited to, melamine resins and benzoguanamine resins, which can improve charge giving ability of the resulting carrier. To more properly control charge giving ability of the resulting carrier, a melamine resin and/or a benzoguanamine resin are/is preferably used in combination with another amino resin.

Examples of the acrylic resin that is cross-linkable with the amino resin include those having a hydroxyl group and/or a carboxyl group. Those having a hydroxy group are more preferred. Such a cross-linked product can improve adhesiveness between the resin layer and both the core particle and conductive particles. In addition, the cross-linked product can improve dispersion stability of the conductive particles in the resin layer. Preferably, the acrylic resin has a hydroxyl value of 10 mgKOH/g or more, more preferably 20 mgKOH/g or more.

The resin layer preferably includes a silane coupling agent to reliably disperse conductive particles.

Specific examples of usable silane coupling agents include, but are not limited to, γ-(2-aminoethyl)aminopropyl trimethoxysilane, γ-(2-aminoethyl)aminopropylmethyl dimethoxysilane, γ-methacryloxypropyl trimethoxysilane, N-β-(N-vinylbenzylaminoethyl)-γ-aminopropyl trimethoxysilane hydrochloride, γ-glycidoxypropyl trimethoxysilane, γ-mercaptopropyl trimethoxysilane, methyl trimethoxysilane, methyl triethoxysilane, vinyl triacetoxysilane, γ-chloropropyl trimethoxysilane, hexamethyl disilazane, γ-anilinopropyl trimethoxysilane, vinyl trimethoxysilane, octadecyldimethyl[3-(trimethoxysilyl)propyl] ammonium chloride, γ-chloropropylmethyl dimethoxysilane, methyl trichlorosilane, dimethyl dichlorosilane, trimethyl chlorosilane, allyl triethoxysilane, 3-aminopropylmethyl diethoxysilane, 3-aminopropyl trimethoxysilane, dimethyl diethoxysilane, 1,3-divinyltetramethyl disilazane, and methacryloxyethyldimethyl(3-trimethoxysilylpropyl) ammonium chloride. Two or more of these materials can be used in combination.

Specific examples of commercially available silane coupling agents include, but are not limited to, AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (from Dow Corning Toray Co., Ltd.).

Preferably, the silane coupling agent is used in combination with a silicone resin. In this case, preferably, the ratio of the silane coupling agent to the silicone resin is from 0.1% to 10% by mass. When the ratio of the silane coupling agent is 0.1% by mass or more, adhesion strength between the core particle/conductive particles and the silicone resin may be improved. When the ratio of the silane coupling agent is 10% by mass or less, the occurrence of toner filming may be prevented in a long-term use.

Preferably, the resin layer has a thickness in the range of from 0.2 to 2 μm. The thickness of the resin layer is measured by obtaining an SEM image of a cross-section of a carrier particle and measuring the distance between one point on the surface of the core material and the surface of the carrier particle in the SEM image. This measurement is performed for at least 5 points on the surface of the core material, and the measured values are averaged.

Preferably, the volume average particle diameter of the magnetic core particle is 20 μm or more for preventing the carrier from depositing or scattering, and is 100 μm or less for preventing a generation of abnormal images (e.g., stripe-like image) and deterioration of image quality. In particular, magnetic core particles having a volume average particle diameter of from 20 to 60 μm can meet a recent demand for higher image quality. The volume average particle diameter can be measured by a Microtrac particle size analyzer HRA9320-X100 (available from Nikki so Co., Ltd.).

As the magnetic core particle, magnetic materials conventionally used for carriers for electrophotographic two-component developers can be used, such as ferromagnetic metals (e.g., iron, cobalt), iron oxides (e.g., magnetite, hematite, ferrite), alloys, and resin particles in which magnetic materials are dispersed. Among these materials, Mn ferrite, Mn—Mg ferrite, and Mn—Mg—Sr ferrite are preferable because they are environmentally-friendly. Specific examples of the magnetic core particle include, but are not limited to, commercially-available products such as MFL-35S and MFL-35HS (available from Powdertech Co., Ltd.); and DFC-400M, DFC-410M and SM-350NV (available from Dowa IP Creation Co., Ltd.).

Preferably, the magnetic core particle (hereinafter "core particle" for simplicity) has a shape factor SF2 in the range of from 120 to 160 and an arithmetic mean roughness Ra in the range of from 0.5 to 1.0 μm. Such a core particle having a specific shape can provide a carrier having superior temporal charge stability and resistance stability. Such a core particle having the specified shape factor SF2 and arithmetic mean roughness Ra is considered to have a proper surface irregularity. Owing to the surface irregularity, the carrier is prevented from undergoing charge decrease and/or resistance increase, which may be caused when a spent toner is adhered to the carrier, since the surface irregularity removes the spent toner off from the carrier. When the shape factor SF2 is 120 or more, the core particle has a proper surface irregularity for removing off the spent toner. When the shape factor SF2 is 160 or less, even after a long-term use of the carrier in a developing device, the core particle may not be exposed at the surface of the carrier, and a change in resistance value of the carrier is small. Thus, the amount and condition of toner on an electrostatic latent image bearer are kept constant, making the image quality stable.

The shape factors SF1 and SF2 can be determined by, for example, imaging 100 randomly-selected core particles with a field emission scanning electron microscope (FE-SEM S-800 available from Hitachi, Ltd.) at a magnification of 300 times, analyzing the image with an image analyzer (LUZEX AP available from Nireco Corporation) through an interface, and calculating from the following formulae (1) and (2).

$$SF1=(L^2/A)\times(\pi/4)\times100 \quad (1)$$

$$SF2=(P^2/A)\times(1/4\pi)\times100 \quad (2)$$

In the formulae (1) and (2), L represents the absolute maximum length of a projected image of a core particle (i.e., the diameter of the circumscribed circle of the projected image), P represents the perimeter of the projected image, and A represents the area of the projected image. The shape factor SF1 represents the degree of roundness of a particle. The shape factor SF2 represents the degree of concavity and convexity of a particle. A particle having a shape far from a sphere has a large SF1 value. A particle having an undulating surface has a large SF2 value.

In the present disclosure, the arithmetic mean roughness Ra is measured by imaging one core particle with a microscope (OPTELICS C130 available from Lasertec Corporation) at an object lens magnification of 50 times and a resolution of 0.20 μm, within a square observing area with each side having a length of 10 μm and extending from an apical part of the core particle. This measurement procedure is applied to 100 core particles.

A two-component developer according to an embodiment of the present invention includes the above-described carrier and a toner.

The toner includes a binder resin. The toner may be either a monochrome toner, color toner, white toner, or transparent toner. The toner may further include a release agent, to be used for oilless fixing systems that include a fixing roller having no oil application. Although such a toner including a release agent is likely to cause a filming problem, the carrier according to an embodiment of the present invention can prevent the filming problem. Therefore, the two-component developer according to an embodiment of the present invention can provide high-quality images for an extended period of time.

The toner can be produced by known methods such as pulverization methods and polymerization methods. The carrier according to an embodiment of the present invention provides the same effect when combined with either a pulverization toner or a polymerization toner.

In a typical pulverization method, raw materials of a toner are melt-kneaded, the melt-kneaded mixture is cooled and pulverized into particles, and the particles are classified by size, thus preparing mother particles. The mother particles then get coated with an external additive to more improve transferability and durability, thus obtaining a toner.

Specific examples of usable kneaders include, but are not limited to, a batch-type double roll mill; Banbury mixer; double-axis continuous extruders such as TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd.), and KEX EXTRUDER (from Kurimoto, Ltd.); and single-axis continuous extruders such as KONEADER (from Buss Corporation).

When being pulverized, the melt-kneaded mixture may be firstly pulverized into coarse particles by a hammer mill or a roatplex, and then the coarse particles may be pulverized into fine particles by a jet-type pulverizer or a mechanical pulverizer. In this case, preferably, the fine particles have an average particle diameter of from 3 to 15 μm.

In classifying the fine particles, a wind-power classifier may be used. In this case, preferably, the fine particles may be classified such that the resulting mother particles have an average particle diameter of from 5 to 20 μm.

The mother particles get coated with the external additive by being mixed with the external additive using a mixer. The external additive gets adhered to the surfaces of the mother particles while being pulverized in the mixer.

Specific examples of usable binder resins include, but are not limited to, homopolymers of styrene or styrene derivatives (e.g., polystyrene, poly-p-styrene, polyvinyl toluene), styrene-based copolymers (e.g., styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer), polymethyl methacrylate, polybutyl methacrylate, polyvinyl chloride, polyvinyl acetate, polyethylene, polyester, polyurethane, epoxy resin, polyvinyl butyral, polyacrylic acid, rosin, modified rosin, terpene resin, phenol resin, aliphatic or aromatic hydrocarbon resin, and aromatic petroleum resin. Two or more of these resins can be used in combination.

Additionally, the following binder resins used for pressure fixing can also be used: polyolefins (e.g., low-molecular-weight polyethylene, low-molecular-weight polypropylene), olefin copolymers (e.g., ethylene-acrylic acid copolymer, ethylene-acrylate copolymer, styrene-methacrylic acid copolymer, ethylene-methacrylate copolymer, ethylene-vinyl chloride copolymer, ethylene-vinyl acetate copolymer, ionomer resin), epoxy resin, polyester resin, styrene-butadiene copolymer, polyvinyl pyrrolidone, methyl vinyl ether-maleic acid anhydride copolymer, maleic-acid-modified phenol resin, and phenol-modified terpene resin. Two or more of these resins can be used in combination.

Specific examples of usable colorants (e.g., pigments, dyes) include, but are not limited to, yellow colorants such as Cadmium Yellow, Mineral Fast Yellow, Nickel Titan Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake; orange colorants such as Molybdenum Orange, Permanent Orange GTR, Pyrazolone Orange, Vulcan Orange, Indanthrene Brilliant Orange RK, Benzidine Orange G, and Indanthrene Brilliant Orange GK; red colorants such as Colcothar, Cadmium Red, Permanent Red 4R, Lithol Red, Pyrazolone Red, Watching Red Calcium Salt, Lake Red D, Brilliant Carmine 6B, Eosin Lake, Rhodamine Lake B, Alizarine Lake, and Brilliant Carmine 3B; violet colorants such as Fast Violet B and Methyl Violet Lake; blue colorants such as Cobalt Blue, Alkali Blue, Victoria Blue Lake, Phthalocyanine Blue, Metal-free Phthalocyanine Blue, Phthalocyanine Blue Partial Chloride, Fast Sky Blue, and Indanthrene Blue BC; green colorants such as Chrome Green, Chrome Oxide, Pigment Green B, and Malachite Green Lake; black colorants such as azine dyes (e.g., Carbon Black, Oil Furnace Black, Channel Black, Lamp Black, Acetylene Black, Aniline Black), metal salt azo dyes, metal oxides, and complex metal oxides; and white colorants such as titanium oxide. Two or more of these colorants can be used in combination. In the case of a transparent toner, a colorant is needless.

Specific examples of usable release agents include, but are not limited to, polyolefins (e.g., polyethylene, polypropylene), fatty acid metal salts, fatty acid esters, paraffin waxes, amide waxes, polyvalent alcohol waxes, silicone varnishes, carnauba waxes, and ester waxes. Two or more of these materials can be used in combination.

The toner may further include a charge controlling agent. Specific examples of usable charge controlling agents include, but are not limited to, nigrosine dyes, azine dyes having an alkyl group having 2 to 16 carbon atoms described in Examined Japanese Application Publication No. 42-1627; basic dyes (e.g., C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040), C. I. Basic Green 4 (C. I. 42000)) and lake pigments thereof; quaternary ammonium salts (e.g., C. I. Solvent Black 8 (C. I. 26150), benzoylmethylhexadecyl ammonium chloride, decyltrimethyl chloride); dialkyl (e.g., dibutyl, dioctyl) tin compounds; dialkyl tin borate compounds; guanidine derivatives; polyamine resins (e.g., vinyl polymers having amino group, condensed polymers having amino group); metal complex salts of monoazo dyes described in Examined Japanese Application Publication Nos. 41-20153, 43-27596, 44-6397, and 45-26478; metal complexes of salicylic acid, dialkyl salicylic acid, naphthoic acid, and dicarboxylic acid with Zn, Al, Co, Cr, and Fe, described in Examined Japanese Application Publication Nos. 55-42752 and 59-7385; sulfonated copper phthalocyanine pigments; organic boron salts; fluorine-containing quaternary ammonium salts; and calixarene compounds. Two or more of these materials can be used in combination. In the case of a toner other than black toner, a metal salt of a salicylic acid derivative that is white is preferable.

Specific examples of usable external additives include, but are not limited to, inorganic particles such as silica, titanium oxide, alumina, silicon carbide, silicon nitride, and boron nitride; and resin particles such as polymethyl methacrylate particles and polystyrene particles, having an average particle diameter of 0.05 to 1 μm, obtainable by soap-free emulsion polymerization. Two or more of these materials can be used in combination. In particular, hydrophobized metal oxide particles (e.g., silica, titanium oxide) are preferable. When a hydrophobized silica and a hydrophobized titanium oxide are used in combination with the amount of the hydrophobized titanium oxide greater than that of the hydrophobized silica, the toner provides excellent charge stability regardless of humidity.

An image forming apparatus according to an embodiment of the present invention includes: an electrostatic latent image bearer; a charger to charge the electrostatic latent image bearer; an irradiator to form an electrostatic latent image on the electrostatic latent image bearer; a developing device to develop the electrostatic latent image formed on the electrostatic latent image bearer into a toner image with the two-component developer according to an embodiment of the present invention; a transfer device to transfer the toner image formed on the electrostatic latent image bearer onto a recording medium; and a fixing device to fix the toner image on the recording medium. The image forming apparatus may further include other devices such as a neutralizer, a cleaner, a recycler, and a controller.

The two-component developer according to an embodiment of the present invention can be used as either a supplemental developer or a developer stored in a trickle developing device. In either case, the surface of the carrier is prevented from being abraded, and the spent toner is prevented from adhering to the surface of the carrier. Thus, either the amount of charge of the developer in the developing device or the electric resistance of the carrier is prevented from lowering, and the carrier reliably provides constant developing property.

Preferably, the developer stored in the developing device has a toner concentration in the range of from 3% to 11% by mass.

Preferably, the supplemental developer contains 2 to 50 parts by mass of a toner based on 1 part by mass of the carrier.

A toner storing unit according to an embodiment of the present invention includes a unit having a function of storing toner; and the above-described developer stored in the unit. The toner storing unit may be in the form of a developer container, a developing device, or a process cartridge.

The developer container is a container storing the developer.

The developing device includes means for storing the developer and developing an image.

The process cartridge includes at least an electrostatic latent image bearer integrated with a developing unit. The process cartridge stores the developer. The process cartridge is detachably mountable on an image forming apparatus. The process cartridge may further include at least one of a charger, an irradiator, and a cleaner.

FIG. 1 is a schematic view of an image forming apparatus according to an embodiment of the present invention. An image forming apparatus 1 illustrated in FIG. 1 is a tandem image forming apparatus including four image forming stations. The image forming stations form respective images with different colors to finally produce a full-color image.

The image forming apparatus 1 includes an automatic document feeder (ADF) 5, a scanner 4 that reads documents, and an image forming unit 3 that forms an image on a recording medium based on a digital signal output from an image processor that electrically processes a digital signal output from the scanner 4. In the scanner 4, a document put on a document table is read by a CCD camera via an emission lamp, a mirror, and a lens. Image information read by the scanner 4 is sent to the image processor. The image processor converts the image information into an image signal to be sent to the image forming unit 3.

The image forming unit 3 includes four image forming stations 10Y, 10C, 10M, and 10K containing respective toners of yellow, cyan, magenta, and black, arranged in tandem, an intermediate transfer belt 21, and a secondary transfer roller 25. The image forming stations 10Y, 10C, 10M, and 10K may be hereinafter collectively referred to as "image forming stations 10". The configuration of each of the image forming stations 10 is described below with reference to the image forming station 10Y containing yellow toner. The image forming stations 10Y, 10C, 10M, and 10K have the same configuration.

Each of the image forming stations 10 may be used as a process cartridge 10 that is detachable from and mountable on the image forming apparatus 1.

As an image forming operation is started, in the yellow image forming station 10Y, a surface of a photoconductor 11Y, serving as an electrostatic latent image bearer, is uniformly charged by a charger 12Y. The photoconductor 11Y includes an electrically-grounded core metal and an organic photosensitive layer formed thereon. A surface of the photoconductor 11Y is uniformly negatively charged by the charger 12Y by corona discharge, and thereafter exposed to light emitted from an irradiator 30 including a laser diode. A part of the charged surface of the photoconductor 11Y, corresponding to an image portion, is irradiated with light, thus forming an electrostatic latent image on the photoconductor 11Y.

As the charged surface of the photoconductor 11Y is exposed to light emitted from the irradiator 30, an electrostatic latent image of an yellow component of an original full-color document is formed thereon. The electrostatic latent image is developed into a yellow toner image with a yellow toner contained in a yellow developing device 13Y. Similarly, a cyan toner image, a magenta toner image, and a black toner image are sequentially formed on the respective photoconductors 11 at a predetermined interval. To sequentially transfer the yellow, cyan, magenta, and black toner images formed on the respective photoconductors 11 onto the intermediate transfer belt 21, primary transfer rollers 23 are disposed facing the respective photoconductors 11 with the intermediate transfer belt 21 therebetween. As a transfer bias is applied to each of the primary transfer rollers 23, the yellow, cyan, magenta, and black toner images are sequentially superimposed on one another on the intermediate transfer belt 21, thereby forming a composite full-color toner image.

After the toner images have been transferred onto the intermediate transfer belt 21, surface potentials of the photoconductors 11 are neutralized by optical neutralizers, and residual toner particles remaining on the photoconductors 11 are removed by respective cleaners 19. The photoconductors 11 are charged by the respective chargers 12 again and a series of the image forming cycle is repeated. The residual toner particles removed by the cleaners 19 are fed to a waste toner container via a waster toner feed path.

After the full-color toner image has been transferred onto a recording medium, residual toner particles and paper powders remaining on the intermediate transfer belt 21 are removed by a cleaning brush roller and a cleaning blade included in an intermediate transfer belt cleaner 22 and fed to the waste toner container. Tension rollers 211 (opposing the secondary transfer roller 25), 212, and 213 are disposed within a transfer unit that involves the intermediate transfer belt 21, a transfer bias power source, and a belt drive shaft. The tension rollers 211, 212, and 213 are controlled by a cam mechanism to impart or release a tension to/from the intermediate transfer belt 21, so that the intermediate transfer belt 21 is brought into contact with or separated from the photoconductors 11.

During an operating period, the intermediate transfer belt 21 is brought into contact with the photoconductors 11 before the photoconductors 11 start rotating. During a non-operating period, the intermediate transfer belt 21 is separated from the photoconductors 11. After the toner images have been transferred onto the intermediate transfer belt 21, surface potentials of the photoconductors 11 are neutralized by optical neutralizers, and residual toner particles remaining on the photoconductors 11 are removed by respective cleaners 19, as described above. In each cleaner 19, first, a brush roller is brought into contact with the photoconductor 11 while rotating in the opposite direction to the rotation of the photoconductor 11 to disturb residual toner particles and attached matters to reduce their adhesive force to the photoconductor 11, at an upstream position relative to the direction of rotation of the photoconductor 11. Next, an elastic rubber blade is brought into contact with the photoconductor 11 to remove the disturbed toner particles and attached matters at a downstream position relative to the direction of rotation of the photoconductor 11.

The composite full-color toner image formed on the intermediate transfer belt 21 is transferred onto a recording medium that is fed to a gap between the intermediate transfer belt 21 and the secondary transfer roller 25, to which a predetermined bias is applied, in synchronization with an entry of the composite full-color toner image into the gap. A transfer device 20 includes the primary transfer rollers 23, the secondary transfer roller 25, the intermediate transfer belt 21, and the intermediate transfer belt cleaner 22.

Multiple sheets of the recording medium are stored in multiple sheet trays 40 disposed in a sheet feeder 2. The sheets, one by one, are drawn from the sheet trays 40 by pickup rollers 42 controlled by the image forming apparatus 1. Each sheet is fed to the image forming unit 3 by feed rollers 43. The sheet is then fed to the secondary transfer roller by registration roller 44 in synchronization with an entry of the toner image on the intermediate transfer belt 21 into the gap between the secondary transfer roller 25.

The sheet having the composite full-color toner image thereon is then fed to a fixing device 50. In the fixing device 50, the composite full-color toner image is fixed on the sheet by application of heat and pressure.

When performing a duplex printing, the sheet is fed to a duplex printing feeder 32 before being fed to an output tray 48. The sheet is fed to the registration roller 44 again so that an image is formed on the other side of the sheet.

The developing device 13 includes a developing sleeve disposed facing the photoconductor 11. The developing sleeve contains a magnetic field generator inside. The charger 12 includes a charging roller disposed facing the photoconductor 11. The charging roller uniformly charges the surface of the photoconductor 11 as a predetermined voltage is applied from a power source, with either contacting or non-contacting the photoconductor 11.

The cleaner 19 includes a cleaning blade that cleans the photoconductor 11. The cleaner 19 further includes a collection blade and a film for collecting toner particles, and a collection coil for conveying the collected toner particles. The cleaning blade may be made of a metal, a resin, or a rubber. In particular, fluorine rubbers, silicone rubbers, butyl rubbers, butadiene rubbers, isoprene rubber, and urethane rubbers are preferable, and urethane rubbers are most preferable. Additionally, a lubricant applicator that applies a lubricant to the photoconductor 11 may be provided. The lubricant may be, for example, a resin (e.g., fluorine resin, silicone resin) or a metal stearate (e.g., zinc stearate, aluminum stearate). In FIG. 1, a numeral 24 denotes a conveyance belt and a numeral 47 denotes an ejection roller.

Each of the image forming stations 10 may be used as a process cartridge.

Figure 2:
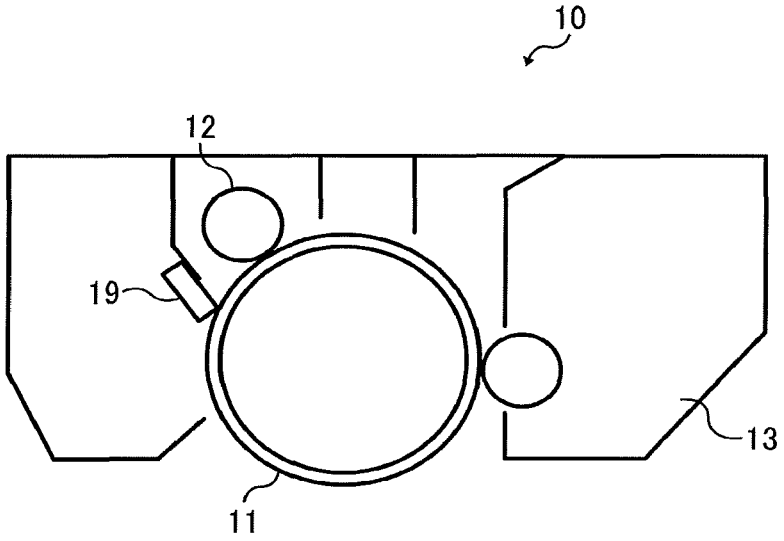
FIG. 2 is a schematic view of a process cartridge according to an embodiment of the present invention.

FIG. 2 is a schematic view of a process cartridge according to an embodiment of the present invention. Referring to FIG. 2, a process cartridge 10 includes a photoconductor 11, a charger 12, a developing device 13, and a cleaner 19. The process cartridge 10 includes the photoconductor 11 and at least one process device. As an irradiator emits laser light to the photoconductor 11, an electrostatic latent image is formed on the photoconductor 11. The process cartridge 10 is detachably mountable on image forming apparatuses such as copiers and printers.

EXAMPLES

Having generally described this invention, further understanding can be obtained by reference to certain specific examples which are provided herein for the purpose of illustration only and are not intended to be limiting. In the descriptions in the following examples, the numbers represent mass ratios in parts, unless otherwise specified.

Preparation of Toner

Binder Resin Preparation Example 1

In a reaction vessel equipped with a condenser, a stirrer, and a nitrogen introducing tube, 724 parts of ethylene oxide 2 mol adduct of bisphenol A, 276 parts of isophthalic acid, and 2 parts of dibutyltin oxide were contained, and subjected to a reaction for 8 hours at 230° C. under normal pressures, and subsequently 5 hours under reduced pressures of from 10 to 15 mmHg. After being cooled to 160° C., the vessel was further charged with 32 parts of isophthalic anhydride, and the vessel contents were subjected to a reaction for 2 hours.

After being cooled to 80° C., the vessel contents were further reacted with 188 parts of isophorone diisocyanate in ethyl acetate for 2 hours. Thus, an isocyanate-containing prepolymer (P1) was obtained.

Next, 267 parts of the prepolymer (P1) was reacted with 14 parts of isophoronediamine for 2 hours at 50° C. Thus, an urea-modified polyester (U1) having a weight average molecular weight of 64,000 was obtained.

In the same manner as described above, 724 parts of ethylene oxide 2 mol adduct of bisphenol A and 276 parts of terephthalic acid were subjected to a polycondensation for 8 hours at 230° C. under normal pressures, and subsequently 5 hours under reduced pressures of from 10 to 15 mmHg. Thus, an unmodified polyester (E1) having a peak molecular weight of 5000 was obtained.

Next, 200 parts of the urea-modified polyester (U1) and 800 parts of the unmodified polyester (E1) were dissolved in 2,000 parts of an ethyl acetate/MEK mixed solvent (in which 1 part of ethyl acetate and 1 part of MEK (methyl ethyl ketone) were mixed) to obtain an ethyl acetate/MEK solution of a binder resin (B1).

A part of the solution was dried under reduced pressures to isolate the binder resin (B1).

Polyester Resin Preparation Example 1

Terephthalic acid: 60 parts Dodecenyl succinic anhydride: 25 parts Trimellitic anhydride: 15 parts Bisphenol A (2,2) propylene oxide: 70 parts Bisphenol A (2,2) ethylene oxide: 50 parts The above compositions were contained in a 1-liter four-necked round-bottom flask equipped with a thermometer, a stirrer, a condenser, and a nitrogen gas introducing tube. The flask was set in a mantle heater to get heated, and charged with nitrogen gas through the nitrogen gas introducing tube so that an inert atmosphere was created therein. While the flask was kept at 200° C., 0.05 g of dibutyltin oxide was added to the flask, and the flask contents were subjected to a reaction. Thus, a polyester resin 1 was obtained.

Master Batch Preparation Example 1

Pigment: C.I. Pigment Yellow 155: 40 parts Binder resin: Polyester resin 1: 60 parts Water 30 parts The above materials were mixed using a HENSCHEL MIXER, thus obtaining a pigment aggregation into which water has permeated. The pigment aggregation was kneaded for 45 minutes using a double roll while setting the surface temperature to 130° C., and then pulverized into particles having a diameter of about 1 mm using a pulverizer. Thus, a master batch (M1) was obtained.

Toner Preparation Example 1

In a beaker, 240 parts of the ethyl acetate/MEK solution of the binder resin (B1), 20 parts of pentaerythritol tetrabehenate (having a melting point of 81° C. and a melt viscosity of 25 cps), and 8 parts of the master batch (M1) were contained, and uniformly stirred using a TK HOMOMIXER at 12,000 rpm and 60° C. Thus, a toner material liquid was prepared.

In another beaker, 706 parts of ion-exchange water, 294 parts of a 10% hydroxyapatite suspension liquid (SUPA-TAITO 10, product of Nippon Chemical Industrial Co., Ltd.), and 0.2 parts of sodium dodecylbenzenesulfonate were contained and heated to 60° C. While the beaker contents were uniformly stirred using a TK HOMOMIXER at 12,000 rpm, the above-prepared toner material liquid was mixed therein, and the beaker contents were further stirred for 10 minutes.

The resulting mixture was transferred to a flask equipped with a stirrer and a thermometer, heated to 98° C. so that the solvent was removed, and successively subjected to the processes of filtration, washing, drying, and wind-power classification. Thus, a mother toner particle 1 was obtained.

Next, 100 parts of the mother toner particle 1 was mixed with 1.0 part of a hydrophobic silica and 1.0 part of a hydrophobic titanium oxide using a HENSCHEL MIXER Thus, a toner 1 was obtained.

The toner 1 had a volume average particle diameter (Dv) of 6.2 μm and a number average particle diameter (Dn) of 5.1 μm, when measured by a particle size analyzer COULTER COUNTER TA-II (available from Beckman Coulter, Inc.) with an aperture diameter of 100 μm.

The toner 1 had an average circularity of 0.96, when measured by a flow particle image analyzer FPIA-1000 (available from Sysmex Corporation). In the measurement of average circularity, 0.1 to 0.5 g of the toner was dispersed in 100 to 150 ml of water from which solid impurities had been removed and 0.1 to 0.5 ml of a surfactant (an alkylbenzene sulfonate) had been added, using an ultrasonic disperser, for about 1 to 3 minutes. The toner concentration in the resulting dispersion was adjusted to 3,000 to 10,000 particles per micro-liter.

Preparation of Particulate Materials

A commercially-available particulate barium sulfate having a volume average particle diameter of 300 nm was purchased and used as a particulate material [a].

A commercially-available particulate barium sulfate having a volume average particle diameter of 400 nm was purchased and used as a particulate material [b].

A commercially-available particulate barium sulfate having a volume average particle diameter of 480 nm was purchased and used as a particulate material [c].

A commercially-available particulate barium sulfate having a volume average particle diameter of 500 nm was purchased and used as a particulate material [d].

A commercially-available particulate barium sulfate having a volume average particle diameter of 600 nm was purchased and used as a particulate material [e].

A commercially-available particulate barium sulfate having a volume average particle diameter of 800 nm was purchased and used as a particulate material [f].

A commercially-available particulate barium sulfate having a volume average particle diameter of 900 nm was purchased and used as a particulate material [g].

A commercially-available particulate barium sulfate having a volume average particle diameter of 1,000 nm was purchased and used as a particulate material [h].

A commercially-available particulate barium sulfate having a volume average particle diameter of 1,010 nm was purchased and used as a particulate material [i].

A commercially-available particulate alumina having a volume average particle diameter of 600 nm was purchased and used as a particulate material [j].

A commercially-available particulate tungsten-doped tin oxide having a volume average particle diameter of 4 nm was purchased and used as a particulate material [1].

A commercially-available particulate tungsten-doped tin oxide having a volume average particle diameter of 5 nm was purchased and used as a particulate material [2].

A commercially-available particulate tungsten-doped tin oxide having a volume average particle diameter of 8 nm was purchased and used as a particulate material [3].

A commercially-available particulate tungsten-doped tin oxide having a volume average particle diameter of 25 nm was purchased and used as a particulate material [4].

A commercially-available particulate tungsten-doped tin oxide having a volume average particle diameter of 30 nm was purchased and used as a particulate material [5].

A commercially-available particulate tungsten-doped tin oxide having a volume average particle diameter of 40 nm was purchased and used as a particulate material [6].

A commercially-available particulate tungsten-doped tin oxide having a volume average particle diameter of 45 nm was purchased and used as a particulate material [7].

A commercially-available particulate tungsten-doped tin oxide having a volume average particle diameter of 48 nm was purchased and used as a particulate material [8].

A commercially-available particulate tungsten-doped tin oxide having a volume average particle diameter of 50 nm was purchased and used as a particulate material [9].

A commercially-available particulate tungsten-doped tin oxide having a volume average particle diameter of 100 nm was purchased and used as a particulate material [10].

A commercially-available particulate tungsten-doped tin oxide having a volume average particle diameter of 105 nm was purchased and used as a particulate material [11].

A commercially-available particulate silica having a volume average particle diameter of 40 nm was purchased and used as a particulate material [12].

Preparation of Carriers

Example 1

Composition of Resin Liquid 1

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [c] (having a volume average particle diameter of 480 nm): 1,000 parts Particulate tungsten-doped tin oxide [8] (having a volume average particle diameter of 48 nm): 600 parts Toluene: 6,000 parts The above materials were subjected to a dispersion treatment using a homomixer for 10 minutes, thus obtaining a resin liquid 1 for forming a resin layer. The resin liquid 1 was coated on a core material made of a Mn—Mg—Sr ferrite having a volume average particle diameter of 35 μm, using a SPIRA COTA (from Okada Seiko Co., Ltd.) at a rate of 25 g/min in an atmosphere having a temperature of 80° C., followed by drying. The resulting coating layer had a thickness of 0.37 μm. The thickness of the coating layer was adjusted by adjusting the amount of the resin liquid. The core material having the coating layer was burnt in an electric furnace at 230° C. for 1 hour, then cooled, and pulverized through a 100-μm sieve. Thus, a carrier 1 was obtained.

The volume average particle diameter of the core material was measured using a Microtrac particle size analyzer HRA (from Nikkiso Co., Ltd.) while setting the measuring range to between 0.71 and 125 μm.

Example 2

Composition of Resin Liquid 2

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [e] (having a volume average particle diameter of 600 nm): 1,000 parts Particulate tungsten-doped tin oxide [5] (having a volume average particle diameter of 30 nm): 600 parts Toluene: 6,000 parts The procedure in Example 1 was repeated except for replacing the resin liquid 1 with the resin liquid 2 having the above composition. Thus, a carrier 2 was obtained.

Example 3

Composition of Resin Liquid 3

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [c] (having a volume average particle diameter of 480 nm): 1,000 parts Particulate tungsten-doped tin oxide [6] (having a volume average particle diameter of 40 nm): 600 parts Toluene: 6,000 parts The procedure in Example 1 was repeated except for replacing the resin liquid 1 with the resin liquid 3 having the above composition. Thus, a carrier 3 was obtained.

Example 4

Composition of Resin Liquid 4

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [f] (having a volume average particle diameter of 800 nm): 1,000 parts Particulate tungsten-doped tin oxide [7] (having a volume average particle diameter of 45 nm): 600 parts Toluene: 6,000 parts The procedure in Example 1 was repeated except for replacing the resin liquid 1 with the resin liquid 4 having the above composition. Thus, a carrier 4 was obtained.

Example 5

Composition of Resin Liquid 5

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [d] (having a volume average particle diameter of 500 nm): 1,000 parts Particulate tungsten-doped tin oxide [4] (having a volume average particle diameter of 25 nm): 600 parts Toluene: 6,000 parts The procedure in Example 1 was repeated except for replacing the resin liquid 1 with the resin liquid 5 having the above composition. Thus, a carrier 5 was obtained.

Example 6

Composition of Resin Liquid 6

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [e] (having a volume average particle diameter of 600 nm): 1,000 parts Particulate tungsten-doped tin oxide [9] (having a volume average particle diameter of 50 nm): 600 parts Toluene: 6,000 parts The procedure in Example 1 was repeated except for replacing the resin liquid 1 with the resin liquid 6 having the above composition. Thus, a carrier 6 was obtained.

Example 7

Composition of Resin Liquid 7

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [d] (having a volume average particle diameter of 500 nm): 1,000 parts Particulate tungsten-doped tin oxide [10] (having a volume average particle diameter of 100 nm): 600 parts Toluene: 6,000 parts The procedure in Example 1 was repeated except for replacing the resin liquid 1 with the resin liquid 7 having the above composition. Thus, a carrier 7 was obtained.

Example 8

Composition of Resin Liquid 8

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [f] (having a volume average particle diameter of 800 nm): 1,000 parts Particulate tungsten-doped tin oxide [3] (having a volume average particle diameter of 8 nm): 600 parts Toluene: 6,000 parts The procedure in Example 1 was repeated except for replacing the resin liquid 1 with the resin liquid 8 having the above composition. Thus, a carrier 8 was obtained.

Example 9

Composition of Resin Liquid 9

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [b] (having a volume average particle diameter of 400 nm): 1,000 parts Particulate tungsten-doped tin oxide [6] (having a volume average particle diameter of 40 nm): 600 parts Toluene: 6,000 parts The procedure in Example 1 was repeated except for replacing the resin liquid 1 with the resin liquid 9 having the above composition. Thus, a carrier 9 was obtained.

Example 10

Composition of Resin Liquid 10

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [h] (having a volume average particle diameter of 1,000 nm): 1,000 parts Particulate tungsten-doped tin oxide [6] (having a volume average particle diameter of 40 nm): 600 parts Toluene: 6,000 parts The procedure in Example 1 was repeated except for replacing the resin liquid 1 with the resin liquid 10 having the above composition. Thus, a carrier 10 was obtained.

Example 11

Composition of Resin Liquid 11

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [a] (having a volume average particle diameter of 300 nm): 1,000 parts Particulate tungsten-doped tin oxide [6] (having a volume average particle diameter of 40 nm): 600 parts Toluene: 6,000 parts The procedure in Example 1 was repeated except for replacing the resin liquid 1 with the resin liquid 11 having the above composition. Thus, a carrier 11 was obtained.

Example 12

Composition of Resin Liquid 12

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [i] (having a volume average particle diameter of 1,010 nm): 1,000 parts Particulate tungsten-doped tin oxide [6] (having a volume average particle diameter of 40 nm): 600 parts Toluene: 6,000 parts The procedure in Example 1 was repeated except for replacing the resin liquid 1 with the resin liquid 12 having the above composition. Thus, a carrier 12 was obtained.

Example 13

Composition of Resin Liquid 13

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [e] (having a volume average particle diameter of 600 nm): 1,000 parts Particulate tungsten-doped tin oxide [6] (having a volume average particle diameter of 40 nm): 600 parts Toluene: 6,000 parts The procedure in Example 1 was repeated except for replacing the resin liquid 1 with the resin liquid 13 having the above composition. Thus, a carrier 13 was obtained.

Example 14

Composition of Resin Liquid 14

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [b] (having a volume average particle diameter of 400 nm): 1,000 parts Particulate tungsten-doped tin oxide [2] (having a volume average particle diameter of 5 nm): 600 parts Toluene: 6,000 parts The procedure in Example 1 was repeated except for replacing the resin liquid 1 with the resin liquid 14 having the above composition. Thus, a carrier 14 was obtained.

Example 15

Composition of Resin Liquid 15

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [e] (having a volume average particle diameter of 600 nm): 1,000 parts Particulate tungsten-doped tin oxide [10] (having a volume average particle diameter of 100 nm): 600 parts Toluene: 6,000 parts The procedure in Example 1 was repeated except for replacing the resin liquid 1 with the resin liquid 15 having the above composition. Thus, a carrier 15 was obtained.

Example 16

Composition of Resin Liquid 16

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [b] (having a volume average particle diameter of 400 nm): 1,000 parts Particulate tungsten-doped tin oxide [1] (having a volume average particle diameter of 4 nm): 600 parts Toluene: 6,000 parts The procedure in Example 1 was repeated except for replacing the resin liquid 1 with the resin liquid 16 having the above composition. Thus, a carrier 16 was obtained.

Example 17

Composition of Resin Liquid 17

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [e] (having a volume average particle diameter of 600 nm): 1,000 parts Particulate tungsten-doped tin oxide [11] (having a volume average particle diameter of 105 nm): 600 parts Toluene: 6,000 parts The procedure in Example 1 was repeated except for replacing the resin liquid 1 with the resin liquid 17 having the above composition. Thus, a carrier 17 was obtained.

Example 18

Composition of Resin Liquid 18

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [e] (having a volume average particle diameter of 600 nm): 1,000 parts Particulate silica [12] (having a volume average particle diameter of 40 nm): 600 parts Toluene: 6,000 parts The procedure in Example 1 was repeated except for replacing the resin liquid 1 with the resin liquid 18 having the above composition. Thus, a carrier 18 was obtained.

Comparative Example 1

Composition of Resin Liquid 19

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate alumina [j] (having a volume average particle diameter of 600 nm): 1,000 parts Particulate tungsten-doped tin oxide [6] (having a volume average particle diameter of 40 nm): 600 parts Toluene: 6,000 parts The procedure in Example 1 was repeated except for replacing the resin liquid 1 with the resin liquid 19 having the above composition. Thus, a carrier 19 was obtained.

Comparative Example 2

Composition of Resin Liquid 20

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [b] (having a volume average particle diameter of 400 nm): 1,000 parts Particulate tungsten-doped tin oxide [10] (having a volume average particle diameter of 100 nm): 600 parts Toluene: 6,000 parts The procedure in Example 1 was repeated except for replacing the resin liquid 1 with the resin liquid 20 having the above composition. Thus, a carrier 20 was obtained.

Comparative Example 3

Composition of Resin Liquid 21

Acrylic resin solution (having a solid content concentration of 20% by mass): 200 parts Silicone resin solution (having a solid content concentration of 40% by mass): 2,000 parts Silane coupling agent (having a solid content concentration of 100% by mass): 10 parts Particulate barium sulfate [g] (having a volume average particle diameter of 900 nm): 1,000 parts Particulate tungsten-doped tin oxide [3] (having a volume average particle diameter of 8 nm): 600 parts Toluene: 6,000 parts The procedure in Example 1 was repeated except for replacing the resin liquid 1 with the resin liquid 21 having the above composition. Thus, a carrier 21 was obtained.

The acrylic resin solution, the silicone resin solution, and the silane coupling agent included in the resin liquids 2-21 obtained in the above Examples 2-18 and Comparative Examples 1-3, respectively, were the same as those included in the resin liquid 1.

The volume average particle diameter (a) of the particulate material A, that is the largest among volume average particle diameters of all particulate materials, and the volume average particle diameter (b) of the particulate material in the resin layer of the carriers 1-21 were determined from a SEM image of a cross-section of each carrier. The results are shown in Table 1.

TABLE 1

| | Volume Average Particle Diameter (a) of Particulate Material A | Volume Average Particle Diameter (b) of Particulate Material B | (a)/(b) |
|---|---|---|---|
| Example 1 | 480 | 48 | 10.0 |
| Example 2 | 600 | 30 | 20.0 |
| Example 3 | 480 | 40 | 12.0 |
| Example 4 | 800 | 45 | 17.8 |
| Example 5 | 500 | 25 | 20.0 |
| Example 6 | 600 | 50 | 12.0 |
| Example 7 | 500 | 100 | 5.0 |
| Example 8 | 800 | 8 | 100.0 |
| Example 9 | 400 | 40 | 10.0 |
| Example 10 | 1000 | 40 | 25.0 |
| Example 11 | 300 | 40 | 7.5 |
| Example 12 | 1010 | 40 | 25.3 |

TABLE 1-continued

| | Volume Average Particle Diameter (a) of Particulate Material A | Volume Average Particle Diameter (b) of Particulate Material B | (a)/(b) |
|---|---|---|---|
| Example 13 | 600 | 40 | 15.0 |
| Example 14 | 400 | 5 | 80.0 |
| Example 15 | 600 | 100 | 6.0 |
| Example 16 | 400 | 4 | 100.0 |
| Example 17 | 600 | 105 | 5.7 |
| Example 18 | 600 | 40 | 15.0 |
| Comparative Example 1 | 600 | 40 | 15.0 |
| Comparative Example 2 | 400 | 100 | 4.0 |
| Comparative Example 3 | 900 | 8 | 112.5 |

Developers 1-21 were prepared by mixing 93 parts of the respective carriers 1-21 and 7 parts of the toner 1 for 3 minutes using a mixer.

Each of the developers 1-21 was set in a digital full-color printer (RICOH PRO C901, product of Ricoh Co., Ltd.). The printer was caused to output a text chart (including texts have a size of about 2 mm×2 mm) having an image area ratio of 5% on 100,000 sheets, and the following evaluations were performed thereafter.

Evaluation of Toner Scattering

The printer was caused to output a white image after outputting the text chart on 100,000 sheets. The white image was subjected to a measurement of image density (ID), using an instrument X-RITE 938 (available from Amtec Co., Ltd) while setting the standard illuminant to D50. The degree of background fouling, caused by the occurrence of toner scattering, was evaluated by the difference in ID (ΔID) between the white image and the blank sheet based on the following criteria.

A+(Very good): $0.02<\Delta ID\leq 0.04$

A (Good): $0.04<\Delta ID\leq 0.10$

B (Acceptable): $0.10<\Delta ID\leq 0.20$

C (Of no practical use): $0.20<\Delta ID$

Evaluation of White Voids in Solid Image Caused by Carrier Scattering

The printer was caused to output a solid image on an A3-size sheet after outputting the text chart on 50,000 sheets and 100,000 sheets. The number of white voids on the solid image, generated by the occurrence of carrier scattering, was counted and evaluated based on the following criteria.

A+ (Very good): 0

A (Good): 1

B (Acceptable): 2

C (Of no practical use): 3 or greater

Evaluation of White Voids on Edge of Solid Image Caused by Carrier Scattering

The printer was caused to output a chart, in which multiple solid square images with each side having a length of 1 cm were arranged at an interval of 1 cm, on an A3-size sheet after outputting the text chart on 100 sheets. The number of white voids on the edges of the solid images, generated by the occurrence of carrier scattering, was counted and evaluated based on the following criteria.

A+(Very good): 0

A (Good): 1 to 5

B (Acceptable): 6 to 10

C (Of no practical use): 11 or more

Evaluation of Edge Effect

The printer was caused to output a test pattern including a large-area image after outputting the text chart on 100 sheets. The degree of edge effect was evaluated by the difference in image density between a central portion (thin portion) and an edge portion (thick portion) of the output image based on the following criteria. A+, A, and B are acceptable, and C is unacceptable.

A+: No difference

A: A slight difference

B: An acceptable level of difference

C: An unacceptable level of difference

The evaluation results are shown in Table 2.

TABLE 2

| | Toner Scattering | Carrier Scattering (Solid Image) 50,000 sheets | Carrier Scattering (Solid Image) 100,000 sheets | Carrier Scattering (Edge of Solid Part) | Edge Effect |
|---|---|---|---|---|---|
| Example 1 | A+ | A+ | A+ | A+ | A+ |
| Example 2 | A+ | A+ | A+ | A+ | A+ |
| Example 3 | A+ | A+ | A+ | A+ | A+ |
| Example 4 | A+ | A+ | A+ | A+ | A+ |
| Example 5 | A+ | A+ | A+ | A+ | A+ |
| Example 6 | A+ | A+ | A+ | A+ | A+ |
| Example 7 | A | A | B | A+ | A |
| Example 8 | A+ | A+ | A | A | A |
| Example 9 | A | A+ | A+ | A+ | A+ |
| Example 10 | A+ | A | A | A+ | A |
| Example 11 | B | A+ | A | A+ | A+ |
| Example 12 | A+ | A | B | A+ | A |
| Example 13 | A+ | A+ | A+ | A | B |
| Example 14 | A | A+ | A | A | A |
| Example 15 | A | A | B | A+ | A+ |
| Example 16 | A | A+ | A+ | B | B |
| Example 17 | A | B | B | A+ | A+ |
| Example 18 | A+ | A+ | A+ | A | A |
| Comparative Example 1 | C | A+ | A | A+ | A+ |
| Comparative Example 2 | C | A | A | A+ | A+ |
| Comparative Example 3 | A+ | B | C | A | C |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A carrier, comprising:

a magnetic core particle; and a resin layer coating a surface of the magnetic core particle, the resin layer comprising a particulate material A having a volume average particle diameter (a) and a particulate material B having a volume average particle diameter (b), wherein the volume average particle diameter (a) of the particulate material A is the largest among volume average particle diameters of all particulate materials included in the resin layer, wherein an inequation $100\geq(a)/(b)\geq 5$ is satisfied, and wherein the particulate material A is barium sulfate.

2. The carrier of claim 1, wherein the volume average particle diameter (a) of the particulate material A is in the range of from 400 to 1,000 nm.

3. The carrier of claim 1, wherein the particulate material B has conductivity.

4. The carrier of claim 1, wherein the volume average particle diameter (b) of the particulate material B is in the range of from 4 to 100 nm.

5. The carrier of claim 1, wherein the particulate material B is a tin oxide compound.

6. A two-component developer comprising:

the carrier of claim 1; and a toner.

7. The two-component developer of claim 6, wherein a concentration of the toner in the two-component developer ranges from 3% to 11% by mass.

8. The two-component developer of claim 6, wherein the toner is at least one selected from the group consisting of a color toner, a white toner, and a transparent toner.

9. An image forming apparatus comprising:

an electrostatic latent image bearer;

a charger to charge the electrostatic latent image bearer;

an irradiator to form an electrostatic latent image on the electrostatic latent image bearer;

a developing device to develop the electrostatic latent image formed on the electrostatic latent image bearer into a toner image with the two-component developer of claim 6;

a transfer device to transfer the toner image formed on the electrostatic latent image bearer onto a recording medium; and a fixing device to fix the toner image on the recording medium.

10. A toner storing unit comprising:

a storing unit; and the two-component developer of claim 6 stored in the storing unit.

11. A supplemental developer comprising:

the carrier of claim 1; and a toner.

12. The supplemental developer of claim 11, wherein a content rate of the toner in the supplemental developer ranges from 2 to 50 parts by mass based on 1 part by mass of the carrier.

13. The carrier of claim 1, wherein the particulate material B is selected from the group consisting of indium-doped tin oxide, phosphor-doped tin oxide, and tungsten-doped tin oxide.

14. The carrier of claim 1, wherein the volume average particle diameter (b) of the particulate material B is in the range of from 25 to 50 nm.

* * * * *